United States Patent [19]

Tarumi et al.

[11] Patent Number: 4,571,068

[45] Date of Patent: Feb. 18, 1986

[54] TONER SUPPLY CONTROLLING DEVICE

[75] Inventors: Noriyoshi Tarumi; Masakazu Fukuchi, both of Hachioji; Kunio Ito, Tama, all of Japan

[73] Assignee: Konishiroku Photo Industry Co., Ltd., Tokyo, Japan

[21] Appl. No.: 474,495

[22] Filed: Mar. 11, 1983

[30] Foreign Application Priority Data

Mar. 18, 1982 [JP] Japan ..... 57-41657
Apr. 12, 1982 [JP] Japan ..... 57-59619

[51] Int. Cl.[4] ..... G03G 15/06; G03G 21/00
[52] U.S. Cl. ..... 355/14 D; 355/3 DD
[58] Field of Search ..... 355/3 R, 3 DD, 14 D

[56] References Cited

U.S. PATENT DOCUMENTS

| | | | |
|---|---|---|---|
| 4,272,182 | 6/1981 | Abe et al. | 355/3 DD X |
| 4,277,549 | 7/1981 | Tatsumi et al. | 355/14 D X |
| 4,313,671 | 2/1982 | Kuru | 355/3 DD X |
| 4,341,461 | 7/1982 | Fantozzi | 355/14 D |

*Primary Examiner*—Fred L. Braun
*Attorney, Agent, or Firm*—James E. Nilles

[57] ABSTRACT

A toner supply controlling device wherein the rate of supply of toner is altered according to information from a monitoring device for monitoring the continuation status of the supply of toner, when the supply of toner is conducted continuously beyond a prescribed level. The monitoring device also monitors the status of a continued stoppage of the supply of toner and, when the stoppage continues beyond a prescribed period of time, the changed rate of supply of toner is returned to the original rate.

3 Claims, 7 Drawing Figures

TONER SUPPLY CONTROLLING DEVICE

BACKGROUND OF THE INVENTION

1. Field of the Invention

The present invention relates to an improvement in a toner supply controlling device in a reproducing apparatus and the like developing an electrostatic latent image by using a developer which is composed of a toner and a carrier, and in the broadest sense it relates to an improvement in a supply controlling device employed to replace the toner consumed in a continuous operation of recording picture images in an electrostatic recording apparatus.

2. Description of the Prior Art

Recently, wide use has been made of electrostatic recording apparatuses, such as reproducing apparatuses, in which a dry developing device using a powdery or granular developer composed of a toner and a carrier is incorporated.

It is known that the density of the toner in the developer has an important effect on the quality of the image and, in particular, on the density of the image, when the development is performed by using a developer which is a mixture of a toner and a carrier. Therefore, various toner supply controlling devices which control the rate of supply of toner to the developer have been proposed and put in practical use.

One example of such a conventional toner supply controlling devices is a device provided with a means for measuring the density of a developed image and a toner supply controlling means controlling the supply of toner on the basis of measurement information obtained therefrom, which is described in the Official Gazette concerning the Japanese Patent Publication No. 16199/1968. This device controls the supply of toner, primarily, so that the density of the developed image, i.e. the development density, is constant, and therefore it is an excellent control device in that it ensures the density of a recorded image more directly than in other devices. Another toner supply controlling device is known which controls the supply of toner so that the density of the toner in the developer is constant by detecting the density by a measurement of the magnetic permeability and color density of the developer. Such a device, however, can only give an indirect assurance of the stability of the development density, and the density of the recorded image closely related to it, although it is preferable for fixing the density of the toner in the developer. Accordingly, in order to obtain a clearly recorded image, a toner supply controlling device which controls according to the development density is preferable.

However, the toner supply controlling device of either of these systems contains elements that could generate errors due to various disturbance factors, and thereby the obstacles described below could occur. Such errors could be caused by errors in the measurement information from the measuring means, or by a malfunction in the electric system of the control device. The following is an explanation of one of these errors which could happen when the supply of toner is controlled according to information on the measured development density. In the device wherein the supply of toner is controlled according to information on the development density, the development density is not only dependent on the density of the toner in the developer, even when the device is designed to determine the development density from a comparison with a reference density plate, and the development density sometimes decreases, although the density of the toner in the developer is correct, because fluctuations of the potential of the electrostatic latent image become large or because the toner is charged far too high (e.g. 40–50 $\mu C/g$) due to frictional electricity generated between the toner and the carrier, when several hundred sheets of copies are prepared in succession, and when the reproduction is conducted successively under such unusual ambient conditions as a temperature of 5° C., and a relative humidity of less than 20%. Since the means for controlling the supply of toner must conduct the supply of toner continuously to ensure the development density, the density of the toner in the developer is increased too much, which results in the scattering a large quantity of toner from the developing device. The scattered toner often adheres to the lens, mirror, etc., of the exposure device or to the electric charger, the transfer device, etc., or reduces the clarity of the recorded image.

SUMMARY OF THE INVENTION

The present invention has been designed to solve these problems plaguing these toner supply controlling devices, and it comes as a result of the attention of the present inventors to the fact that the frequency or duration of the continued supply of toner can serve as a criterion of whether the conditions are unusual or not.

An object of the present invention is to furnish a toner supply controlling device which is designed to monitor the continuation status of the supply of toner so as to prevent the density of the toner in the developer from becoming too high.

Another object of the present invention is to offer a toner supply controlling device which is designed to detect other conditions affecting the development density than conditions of the developer so as to prevent the density of the toner in the developer from becoming too high, based on detected information.

Still another object of the present invention is to obtain a toner supply controlling device which comprises a means of measuring the density of an image obtained by developing an electrostatic latent image by a developer composed of a toner and a carrier, a toner supply controlling means controlling the supply of toner to the developer based on the measurement information obtained by the measurement means, and a means of detecting such conditions before development that affect the measurement information, and which is designed to change the level of said measurement information based on which the supply of toner is continued or discontinued, according to information from said detection means, and thereby prevent the density of the toner in the developer from becoming too high.

Other purposes of the present invention and the characteristic features thereof will be made clear in the course of the following explanation with reference to the drawings.

DESCRIPTION OF THE PREFERRED EMBODIMENTS

Figure 1:
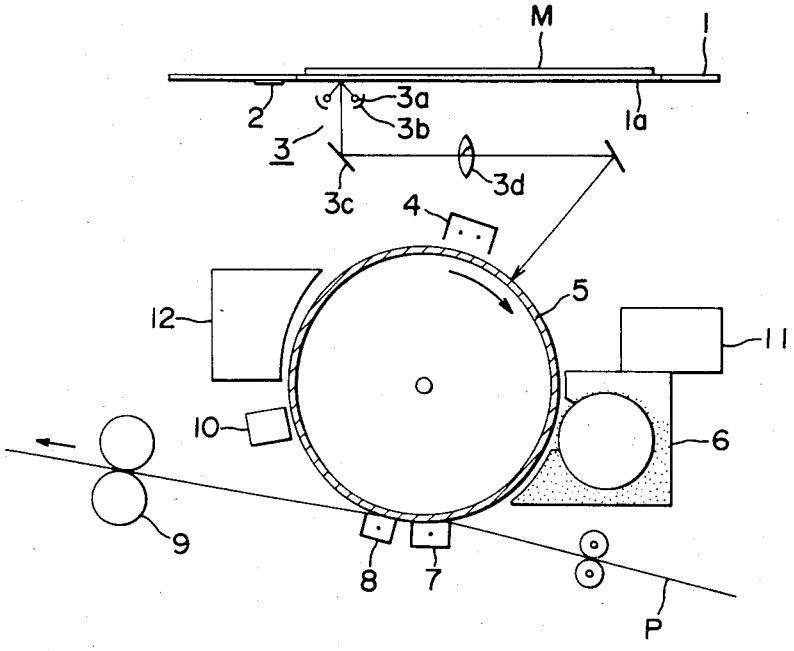
FIG. 1 is a structural view of the principal parts of an electrophotographic reproducing apparatus of the present invention.
Figure 2:
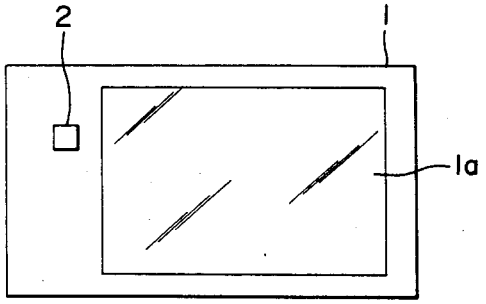
FIG. 2 is a plan view of the base of the document table.

The reproducing apparatus shown in FIG. 1 is fitted with a reference density plate 2 for the measurement of development density at one end of the lower surface of a document table 1, as shown in FIG. 2. When the reproduction operation is started with a document M placed on a document glass plate 1*a* of the document table 1, a photosensitive drum 5 rotates in the direction of an arrow, an electric charger 4 charges the surface of the photosensitive drum 5 uniformly, a lamp 3*a* of an exposure device 3 is lit, and either the document table 1 or the exposure device 3 including the lamp 3*a*, a reflection shade 3*b*, a mirror 3*c*, a lens 3*d*, etc., is moved in the horizontal direction synchronously with the rotation of the photosensitive drum 5, whereby the image of the document M including the reference density plate 2 is exposed on the uniformly-charged surface of the photosensitive drum 5. The electrostatic latent image on the photosensitive drum 5 formed in this way is subjected to toner development by a developing device 6 and the image of the document M developed in the toner developing device is transferred onto recording paper P by a transfer device 7. The recording paper P onto which the transfer has been made is then separated from the surface of the photosensitive drum 5 by a separating device 8 and is discharged from the machine via a fixing device 9, thus completing the reproduction. The image of the reference plate 2 developed passes the positions of the transfer device 7 and the separating device 8 without being transferred onto the recording paper P, and the density of the toner-developed image is measured by a density measuring means 10. The supply of toner from a toner supplying device 11 to the developing device 6 is conducted or discontinued according to whether or not the information from the measurement means 10 is below a prescribed level. A decrease in the development density due to a reduction in the density of the toner in the developer is thereby prevented, and the development density is maintained at a fixed value by changes in the density of the toner in the developer, even when fatigue occurs in the photosensitive drum 5, the ambient conditions change, or the exposure conditions change. During the development of the electrostatic latent image, it is preferable for the development of the electrostatic latent image of the reference density plate 2 that a bias voltage applied on the developing device 6 is controlled so that it has the same polarity as that of the charge on the electrostatic latent image of the reference density plate, and is equal to or lower than a bias voltage applied when the electrostatic latent image of the document M is developed, so as to prevent the generation of fogging of the development, while it is preferable for the development of the electrostatic latent image of the document M that the bias voltage is controlled so that it has the same polarity as that of the charge on the electrostatic latent image of the document M, and is sufficiently higher than the potential of the surface thereof. Because of this, the development of the electrostatic latent image of the reference density plate 2 has a uniform density with very little edge effects, and the development of the electrostatic latent image of the document M is clearly defined from the non-image portion.

After the surface of the photosensitive drum 5 has passed the position of the density measuring means 10, it is cleared of the toner by a cleaning device 12 so that it becomes a clean surface and, as the drum 5 continues to rotate further, charging and exposure are made again thereon and thus the next reproduction is performed.

The details described above are the same as those described in the Official Gazette concering the Japanese Patent Publication No. 16199/1968 which is known publicly. Since the density of the development is ensured by changing in the density of the toner in the developer, there is a danger of an excessive increase in the density of the toner in the developer when the decrease in the development density is caused by a factor other than a change in the density of the toner in the developer. This will be explained with reference to FIGS. 3 and 4.

Figure 3:
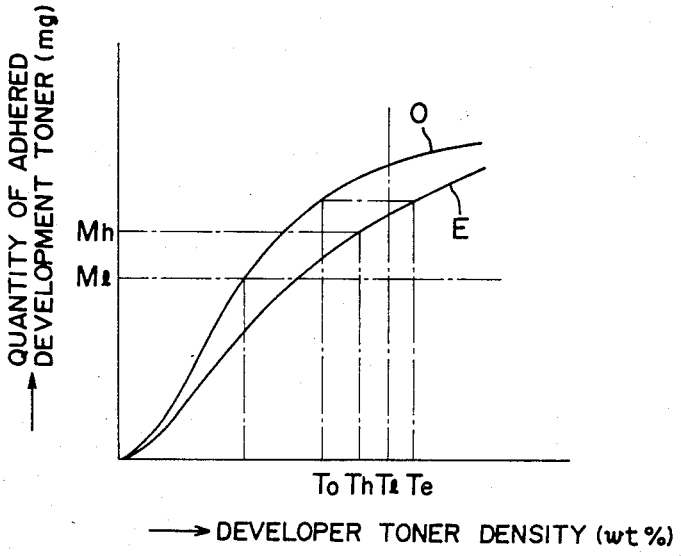
FIG. 3 is a graph showing the relationship between the density of the toner in a developer and the quantity of adhered development toner.

In FIG. 3, the relationship between the density of toner in the developer and the quantity of adhered development toner follows the curve 0 under ordinary conditions. The relationship between the density of toner and the photosensor output obtained from the measurement of the development density follows the curve 0 in FIG. 4. When the output V of the photosensor is greater than a fixed level $V_0$, the toner supplying device 11 of FIG. 1 supplies toner, and when $V \leqq V_0$, it stops the supply thereof. Therefore, the density of the toner in the developer is maintained approximately at a fixed level $T_0$, which does not exceed a density limit Tl at which such problems as staining inside the machine take place. However, when several hundred sheets are copied in succession, the relationship between the density of the toner in the developer and the quantity of adhered development toner changes as shown by the curve E in FIG. 3 and, at the same time, the output of the photosensor also changes as shown by the curve E in FIG. 4. When the supply of toner is controlled by the output V of the photosensor based on the same fixed reference level $V_0$, the frequency or the duration of the continued toner supply increases and thus the density of the toner in the developer is maintained at a level Te exceeding the density limit Tl, which also causes such problems as staining inside the machine due to scattering of the toner.

The main points of the present invention are described in the following. The first is that the invention offers a constitution wherein the frequency or duration of the continued supply of toner are recorded and the supply of toner is forcibly stopped when the frequency or duration reaches an appropriate level, so that the density of the toner in the developer can be prevented from exceeding the density limit. The second is that it offers a constitution wherein the prescribed reference level $V_0$ by which the supply of toner is controlled by the output V of the photosensor is changed to another prescribed reference level Vh which is lower than the level of an output Vl of the photosensor corresponding to the quantity Ml of adhered development toner which is a limit enabling sufficient reproduction, and which is higher than the reference level $V_0$, and which serves to hold the density of the toner in the developer below the density limit Tl, instead of stopping the supply of toner, when the relationship of the density of the toner in the developer to the quantity of adhered development toner, and the output of the photosensor, are as shown by the curve E in FIGS. 3 and 4. By this constitution, the density of the toner in the developer is held at a level Th below the density limit Tl and, in addition, the amount of adhered development toner exceeds a limiting amount Ml of adhered toner, whereby a clear reproduction is ensured without the occurrence of any problems such as staining inside the machine.

Figure 5:
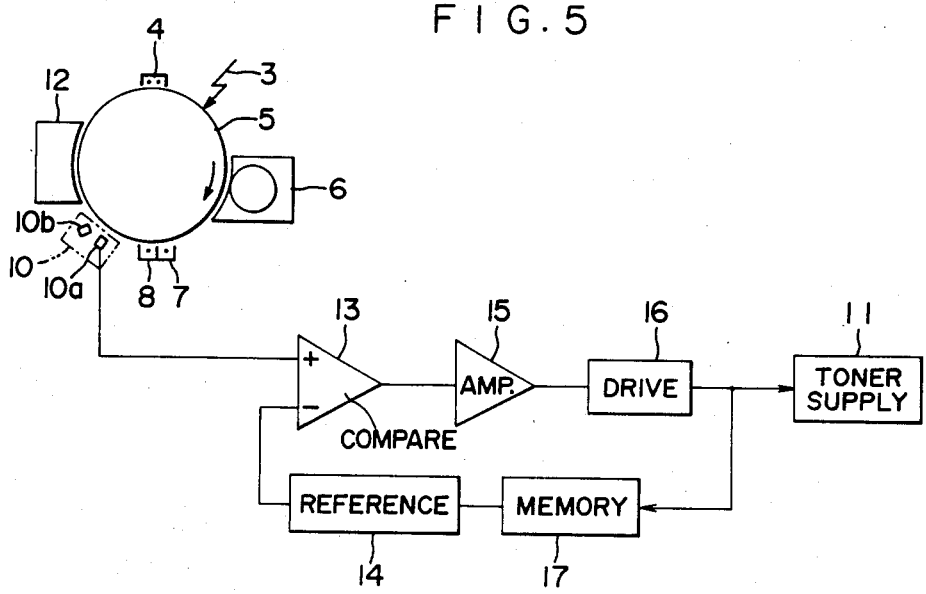
FIG. 5 is a schematic structural view illustrating one embodiment of the toner supply controlling device of the present invention.

The apparatus shown in FIG. 5 is an embodiment of the above second main point of the present invention.

In FIG. 5, the output of the photosensor 10*a* of the density measuring means 10 is applied to the positive terminal of a comparator 13, while a prescribed output voltage of a reference voltage output circuit 14 is applied to the negative terminal thereof, and the comparator 13 applies a toner supply signal to a driving circuit 16 through an amplifier 15 when the voltage at the positive terminal is larger than the voltage at the negative terminal. When the driving circuit 16 receives this signal, it drives the toner supplying device 11 to make it supply toner to the developing device 6, while driving a memory control circuit 17 to make it store the frequency or the duration of the supply of toner after the reception of the toner supply signal. When the input of the toner supply signal stops, the driving circuit 16 makes the toner supply device 11 discontinue the supply of toner, while making the memory control circuit 17 clear its memory. When the stored frequency or duration of the supply of toner reaches a prescribed value, the memory control circuit 17 changes the prescribed output voltage of the reference voltage output circuit 14 to another prescribed output voltage described above, which is higher than the former voltage, while clearing the stored frequency or duration of the supply of toner and starts the storage afresh. Since the reference voltage at the negative terminal is raised thereby, the comparator 13 generates the toner supply signal based on a new reference, whereby an excessive increase in the density of the toner in the developer is prevented and the continuation of the clear reproduction is ensured. It is also possible to provide the memory control circuit 17 additionally with a function to store a count of the time that the supply of toner is discontinued during the reproduction operation and to return the prescribed output voltage of the reference voltage output circuit 14 to the original low prescribed output voltage when the discontinuation time exceeds a prescribed value. When such a function is added, the original control conditions are restored automatically when the ambient conditions, etc. return to their normal states. In the embodiment of the first main point of the present invention described above, that is, when the supply of toner is forcibly stopped, it is sufficient to provide a switching means, for instance, on the input side of the driving circuit 16 and release the switching means instead of changing the output voltage of the reference voltage output circuit 14 by the output from the memory control circuit 17.

Figure 6:
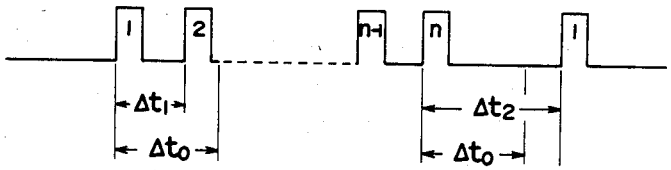
FIG. 6 is a timing chart showing examples of a toner supply signal.

The operation of the memory control circuit 17 will be further explained below with reference to FIG. 6. The memory control circuit 17 is constituted so that it counts the toner supply signals if they are applied within a prescribed time interval $\Delta t_0$ and clears the contents of the count memory if no signal is applied within $\Delta t_0$, when the toner supplying device 11 is operating intermittently. With reference to FIG. 6, a signal applied within a time interval $\Delta t_1$ which is smaller than $\Delta t_0$ is stored as a continuous signal up to signal n. If the signal n+1 is applied after a time interval $\Delta t_2$ larger than $\Delta t_0$, the count before that is cleared and the count is started again from signal n+1. In a case wherein toner supply signals are applied successively, the time is totalled while the signal continues, and the stored time is cleared when the signal stops.

Needless to say the above time interval $\Delta t_0$ may be changed according to the size of the document or recording paper which is being transferred.

The fixed value m of the frequency or duration of the supply of the toner can be determined in the following way, in accordance with the above description. If the amount of the developer in the developing device 6 is taken as Wg and the amount of toner supplied at a time or during a unit time as Wg, the value m is determined so that the formula $100\ mw/W \leqq \Delta(T)$ is satisfied. $\Delta T$ is a value fixed according to the kind of carrier in the developer employed, and when a spherical carrier coated with insulating resin and having an average particle size of $100\mu$ is used, for instance, it is preferable that the density $T_0$ of the toner in the developer which is maintained by ordinary control conditions is within a range of 1.5 to 2.5% by weight. By taking $\Delta T$ to be 2 in this case, the density of the toner in the developer is controlled to have a maximum value of 3.5 to 4.5% by weight, whereby staining inside the machine, etc., due to scattering of the toner is prevented. When a pulverized iron carrier is used for the developer, the density $T_0$ of the toner in the developer and the density limit Tl under ordinary control conditions have larger values than those when the spherical carrier coated with insulating resin is used, and thus the value of $\Delta T$ can be larger.

As described above, the toner supply controlling device proposed by the present invention enables the attainment of the advantage that it ensures the direct attainment of a clearly recorded image without causing any staining inside the machine.

Moreover, the application of the present invention is not limited to a system which copes with changes causing a reduction in the development density. It may also be applied to a system which copes with changes causing an increase in the development density, as was described in connection with the monitoring and control of the time during which the supply of toner is discontinued.

Another embodiment of the present invention will be explained below with reference to FIG. 7.

Figure 4:
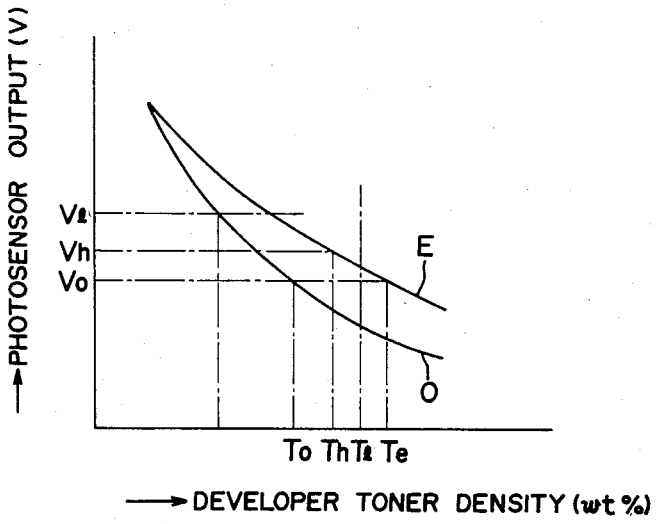
FIG. 4 is a graph showing the relationship between the density of the toner in the developer and the output of a photosensor detecting reflected light when the measurement of the development density is conducted by the photosensor.
Figure 7:
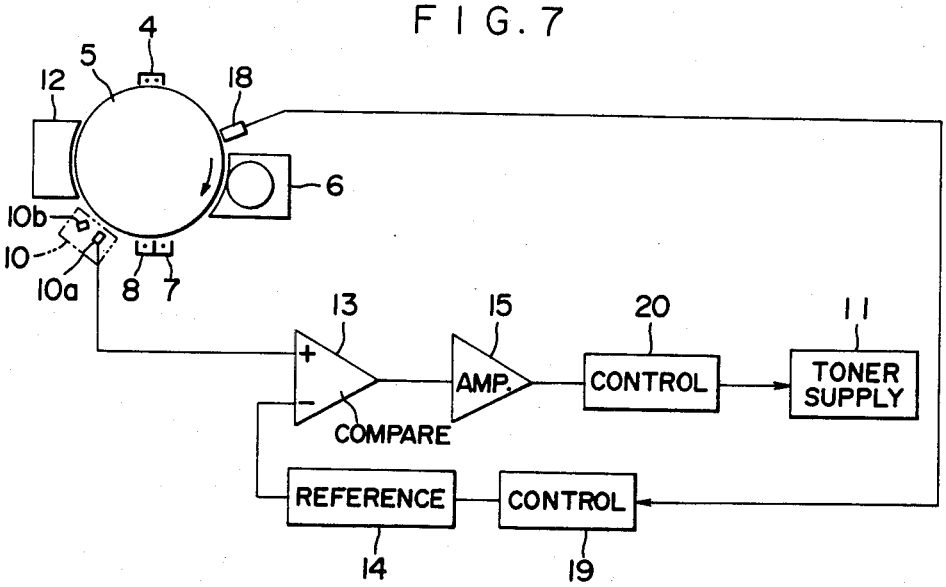
FIG. 7 is a schematic structural view of a toner supply device of another embodiment of the present invention.

In the embodiment shown in FIG. 7, a judgement is made as to whether or not the relationship of the density of toner in the developer to the quantity of adhered development toner, and to the output of the photosensor is similar to that shown by the curve E in FIGS. 3 and 4, according to the potential of the electrostatic latent image before development, and based on the result of the judgement, a prescribed level controlling the supply of the toner is altered.

In FIG. 7, a potential sensor 18, driven by a potential sensor control circuit 19, detects the potential of the electrostatic latent image of the reference density plate 2 of FIGS. 1 and 2. The potential sensor control circuit 19 makes the reference voltage output circuit 14 to apply the reference voltage $V_0$ to the negative terminal of the comparator 13 when the detected potential exceeds a prescribed potential, while making the circuit 14 to apply the reference voltage Vh when the detected potential is below the prescribed potential. When the detected potential is above the prescribed potential the relationships shown by the curve 0 in FIGS. 3 and 4 hold, while when the former is below the latter the relationships shown by the curve E hold. Accordingly, in the state in which the relationships shown by the curve 0 hold, the comparator 13 compares the output V of the photosensor 10*a* of the density measuring means 10 with the reference voltage $V_0$ and, by an amplifier circuit 15, makes a toner supply control circuit 20 to apply a toner supply signal to make the toner supplying device 11 to supply the toner to the developing device 6, only when V is larger than $V_0$. In the state in which the relationships shown by the curve E hold, it compares the output V with the reference voltage Vh and makes the toner supplying device 11 to supply the toner to the developing device 6 only when V is larger than Vh. These operations prevent an excessive increase in the density of the toner in the developer as mentioned previously, enabling the attainment of the advantage that a clear reproduction is performed.

In FIG. 7, the members having the same functions as those in FIG. 1 are indicated by the same numerals and symbols. 10*b* indicates a photodiode.

The application of the present invention is not limited to the embodiments described above. For instance, the surface of the photosensitive drum 5 charged by the electric charger 4 may be used as the surface from which the potential is detected of the potential sensor 18, while the development of the charged surface which is not exposed can be used for the measurement of the development density without the provision of the reference density plate 2. Moreover, in a system wherein fluctuations of the potential of the electrostatic latent image on the photosensitive drum 5 are mainly affected by the exposure conditions, the reference voltage controlling the supply of the toner may be altered, in the application of the present invention, by the detected change in the intensity of light reflected from the reference density plate 2.

What is claimed is:

1. In a toner supply controlling device controlling the supply of toner in accordance with a measurement information obtained from a measurement of a developed toner image on a non-image area of a photoreceptor, relating to a reference density image, the improvement comprising a monitoring means for monitoring a continuation status of said supplying of toner, and an altering means for altering a control condition of supplying toner when said continuation status goes up beyond a prescribed level according to a signal from said monitoring means.

2. The toner supply controlling device according to claim 1, wherein said altering means alter the control condition to the discontinuation of the supply of toner.

3. The toner supply controlling device according to claim 1, wherein said altering means alter said prescribed level based on which a decision on the continuation or discontinuation of the supply of toner is made according to said measurement information obtained from the measurement of the development density.

* * * * *